US008968048B2

(12) United States Patent
Oren et al.

(10) Patent No.: US 8,968,048 B2
(45) Date of Patent: Mar. 3, 2015

(54) ACTIVITY MAT

(75) Inventors: Shoshana Oren, Tel Aviv (IL); Fredrik Aboukrat, Kfar Saba (IL); Giora Shachal, Tel Aviv (IL)

(73) Assignee: Tiny Love Ltd., Tel Aviv (IL)

( * ) Notice: Subject to any disclaimer, the term of this patent is extended or adjusted under 35 U.S.C. 154(b) by 576 days.

(21) Appl. No.: 13/101,316

(22) Filed: May 5, 2011

(65) Prior Publication Data

US 2011/0275273 A1 Nov. 10, 2011

Related U.S. Application Data

(60) Provisional application No. 61/331,973, filed on May 6, 2010.

(51) Int. Cl.

| | |
|---|---|
| ***A63H 33/00*** | (2006.01) |
| ***A47D 13/00*** | (2006.01) |
| ***E04H 15/00*** | (2006.01) |

(52) U.S. Cl.

CPC ..... *A63H 33/006* (2013.01); *E04H 15/006* (2013.01); *A47D 13/00* (2013.01); *A63B 2208/12* (2013.01)

USPC ..... 446/227; 446/228; 5/93.1; 5/97; 5/417; 5/655; 482/35; 135/124; 135/125; 135/135; 135/137

(58) Field of Classification Search

CPC .... A63H 33/06; A63B 2208/12; E04H 15/34; A47D 15/003

USPC ..... 446/227, 228; 5/93.1, 97, 417, 655; 482/35; 135/124, 125, 137, 135

See application file for complete search history.

(56) References Cited

U.S. PATENT DOCUMENTS

| | | | | | |
|---|---|---|---|---|---|
| 5,059,463 | A | * | 10/1991 | Peters | 428/64.1 |
| 5,642,750 | A | * | 7/1997 | Brown et al. | 135/137 |
| D408,192 | S | * | 4/1999 | Chiang | D6/596 |
| 5,928,054 | A | * | 7/1999 | Mast | 446/227 |
| 5,930,854 | A | * | 8/1999 | O'Neill et al. | 5/655 |
| 6,178,978 | B1 | * | 1/2001 | Rieber | 135/96 |
| 6,296,415 | B1 | * | 10/2001 | Johnson et al. | 403/170 |
| 6,467,107 | B1 | * | 10/2002 | Glover et al. | 5/99.1 |
| 6,702,643 | B1 | * | 3/2004 | Drosendahl et al. | 446/227 |
| 7,037,170 | B2 | * | 5/2006 | Pacella et al. | 446/268 |
| 7,096,874 | B2 | * | 8/2006 | Forshpan | 135/96 |
| 7,117,552 | B2 | * | 10/2006 | Hoffman | 5/655 |
| 7,290,303 | B2 | * | 11/2007 | Mead et al. | 5/655 |
| 7,302,724 | B2 | * | 12/2007 | Solomon et al. | 5/655 |
| 7,376,993 | B2 | * | 5/2008 | Myers et al. | 5/655 |

(Continued)

FOREIGN PATENT DOCUMENTS

| | | |
|---|---|---|
| CN | 2545917 | 4/2003 |
| CN | 2627931 | 7/2004 |

(Continued)

*Primary Examiner* — Gene Kim
*Assistant Examiner* — Alexander Niconovich
(74) *Attorney, Agent, or Firm* — Dorsey & Whitney LLP

(57) ABSTRACT

An infant activity device comprising two or more arches configured for creating an activity space therebelow defined by a location of articulation of the arches, and further comprising an arch configuration member configured for displacement between different articulation configurations of the arches by sliding with respect to at least one arch and further configured for retaining the arches at any desired articulation configuration to thereby alter the activity space.

11 Claims, 14 Drawing Sheets

(56) References Cited

U.S. PATENT DOCUMENTS

| | | | | |
|---|---|---|---|---|
| 7,490,379 | B2 * | 2/2009 | Solomon et al. | 5/655 |
| 7,841,572 | B2 * | 11/2010 | Chen et al. | 248/317 |
| 7,926,500 | B2 * | 4/2011 | Perez et al. | 135/137 |
| 8,070,552 | B2 * | 12/2011 | Snyder | 446/227 |
| D652,180 | S * | 1/2012 | Haaf | D30/160 |
| D653,005 | S * | 1/2012 | Haaf | D30/160 |
| 8,257,229 | B2 * | 9/2012 | Myers et al. | 482/35 |
| 8,388,501 | B2 * | 3/2013 | Myers et al. | 482/35 |
| 8,430,711 | B2 * | 4/2013 | Chininis et al. | 446/227 |
| 8,460,053 | B2 * | 6/2013 | Fair et al. | 446/227 |
| 8,795,023 | B2 * | 8/2014 | Elson | 446/227 |
| 2004/0266312 | A1 * | 12/2004 | Oren et al. | 446/227 |
| 2007/0066446 | A1 * | 3/2007 | Gelfond et al. | 482/23 |
| 2009/0253342 | A1 * | 10/2009 | Oren et al. | 446/227 |
| 2010/0029170 | A1 * | 2/2010 | Hall | 446/227 |
| 2011/0065353 | A1 | 3/2011 | Chininis et al. | |

FOREIGN PATENT DOCUMENTS

| | | |
|---|---|---|
| CN | 201220121 | 4/2009 |
| JP | 2005-342365 | 12/2005 |
| WO | WO2007/026359 | 3/2007 |

* cited by examiner

ACTIVITY MAT

CROSS-REFERENCE TO RELATED APPLICATIONS

This application claims the benefit of U.S. Provisional Application No. 61/331,973 filed on 6 May 2010, the disclosure of which is incorporated herein, in its entirety, by this reference.

TECHNICAL FIELD

This subject matter relates to infant activity devices, often referred to also as developmental toys or infant activity/entertainment center. More particularly, the presently disclosed subject matter is directed to an activity device that is configurable in many different ways.

BACKGROUND

There are known activity devices often used as infant developments and amusing toys for infant lying on the flour or in a cradle, or when sitting in a stroller or a bouncer.

Some examples for activity devices are disclosed in WO2007/026359.

SUMMARY

The presently disclosed subject matter provides an infant activity device that is configurable in many different settings and wherein an activity space surrounding an infant below the device may be changed depending on the location of the infant, such that stimulating elements may be provided, in particular at that space, and further wherein the stimulating elements may be suspended at an appropriate distance from the infant.

According to the disclosed subject matter, there is provided an infant activity device comprising two or more arches configured for creating an activity space extending below a location of articulation of the arches, and further comprising an arch configuration member configured for displacement between different articulation configurations of the arches by sliding with respect to at least one arch and further configured for retaining the arches at any desired articulation configuration to thereby alter the activity space.

The location of articulation, according to the presently disclosed subject matter, is defined as a point or an area in which the distance between the arches it minimal or, in case the arches are in direct contact, the location of contact, intersection or tangent therebetween.

The activity space, according to the presently disclosed subject matter, is defined as an area below the location of articulation of the arches, as defined above, and in particular, below the arch configuration member.

Any one or more of the following features and designs may be included in the infant activity device, according to the presently disclosed subject matter, in combination or independently:

- The arch configuration member is retained at the location of articulation when retaining the arches at an articulation configuration corresponding to the location;
- The arch configuration member comprises at least one an arch receptacle configured for slidingly receiving therein two or more arches;
- The arch configuration member comprises a retention mechanism for retaining the arches in the desired articulation configuration;

- The arch configuration member is retained in position by friction between the arch configuration member and the arches;
- The arch configuration member is a releasable clamping arrangement configured for displacement over the arches and further configured for retaining them at any desired configuration;
- The arches are configured to be detachably attached to an infant equipment such as an activity mat, a bed, a bouncer, a safety chair, a cradle or a stroller;
- The arches comprise one or more attachment points for attaching the activity device to infant equipment and with respect to which the arches are configured to change their articulation configuration;
- The arches comprise two or more arch couplers for detachably attaching the arches to the infant equipment;
- The activity device comprise one or more stimulating elements configured to be provided within the activity space;
- The activity device comprise one or more stimulating element couplers slidably displaceable over the arches;
- At least one stimulating element is configured to be detachably attached to the arch configuration member.

In accordance with another aspect of the presently disclosed subject matter, there is provided an infant activity mat comprising two or more arches configured for creating an activity space extending below a location of articulation of the arches, and further comprising an arch configuration member configured for displacement between different articulation configurations of the arches by sliding with respect to at least one arch and further configured for retaining the arches at any desired articulation configuration to thereby alter the activity space.

The arches comprise one or more attachment points at which the device is configured to be detachably attached to the mat and with respect to which the arches are configured to change their articulation configuration and may further comprise two or more arch couplers for detachably attaching the arches to the mat.

In accordance with another aspect of the presently disclosed subject matter, there is provided an arch configuration member for use in an activity device having two or more arches configured for creating an activity space extending below a location of articulation of the arches. The arch configuration member comprises an arch receptacle configured for slidingly receiving therein the arches, for displacement between different articulation configurations of the arches by sliding with respect to at least one arch, and for retaining the arches at any desired articulation configuration to thereby alter the activity space.

BRIEF DESCRIPTION OF THE DRAWINGS

In order to understand the presently disclosed subject matter and to see how it may be carried out in practice, embodiments will now be described, by way of non-limiting examples only, with reference to the accompanying drawings, in which.

DETAILED DESCRIPTION OF EMBODIMENTS

Attention is first directed to FIG. 1A of the drawings illustrating an infant activity device 10 comprising a pair of arches 26 articulated so as to define an entertainment space/activity space S substantially below an articulation point P of the arches 26 surrounding an infant (not shown), whereby the shape and orientation of the space S may be easily altered above the infant, by simple manipulation of the arches 26 and their retention at a respective position, to be discussed hereinafter.

The activity device 10 is configured to be detachably attached to infant equipment such as, for example, an activity mat (as shown in FIGS. 3A to 3E), a bouncer, a safety chair, a cradle or a stroller, by means of suitable couplers.

Figure 1A:
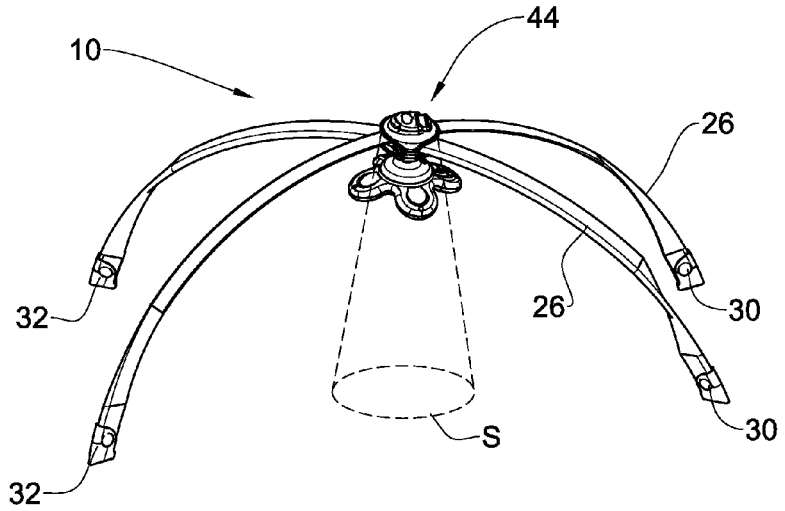
FIGS. 1A and 1B are top perspective views of an activity device in accordance with the presently disclosed subject matter, with and without an arch configuration member, respectively.
Figure 1B:
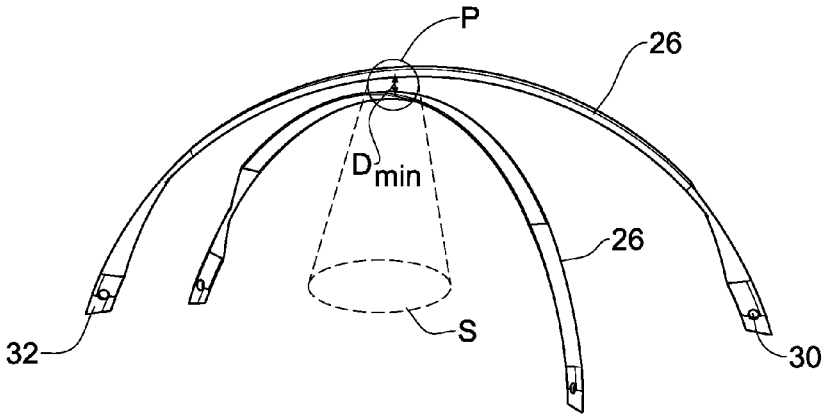
Figure 1C:
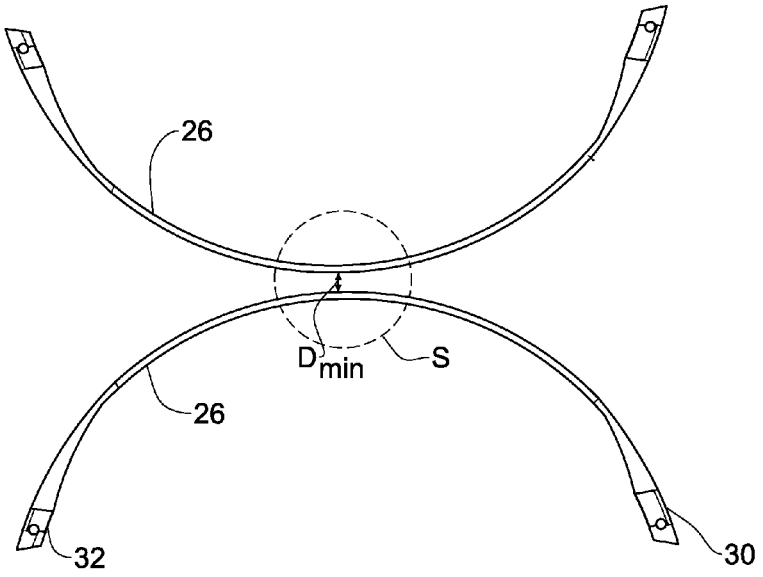
FIG. 1C is a top view the activity mat in accordance with the presently disclosed subject matter showing another example of its arch configuration.

The arches 26 can normally be in a cross configuration, as shown in FIGS. 1A and 1B, or adjacent one to the other, as shown in FIG. 1C, and in any of the above configurations the arches 26 can be in direct contact or distanced one from the other, so that the articulation point P of the arches 26 defined as a location of a minimal distance $D_{MIN}$ (FIGS. 1B and 1C) therebetween. Each arch 26 comprises at least one point of attachment to infant equipment, as indicated above, and preferably comprises two points of attachment, such as for example the ends 30 and 32 of the arch 26.

The arches 26 can change their configuration by movement and/or rotation with respect to the points of attachment, different examples of which are shown in FIGS. 1A, 3A, 3B, 3C, 11A and 11B.

The arch configuration member 44, several examples of which are described herein below in detail, is configured for displacement between different articulation configurations of the arches by sliding with respect to at least one arch and further configured for retaining the arches at any desired articulation configuration, altering thereby the activity space S, as shown in dotted lines in FIGS. 1A, 1B, 11A and 11B. The arch configuration member 44 may further comprise a retention mechanism for retaining the arches in the desired articulation configuration.

When retaining the arches in the desired configuration, the arch configuration member 44 is located substantially at the articulation point P (FIG. 1B, showing only the point without the arch configuration member). The displacement of the arch configuration member 44 result in change in configuration of one or both arches 26 and, consequently, in displacement of the point P which defines the activity space S.

Figure 1D:
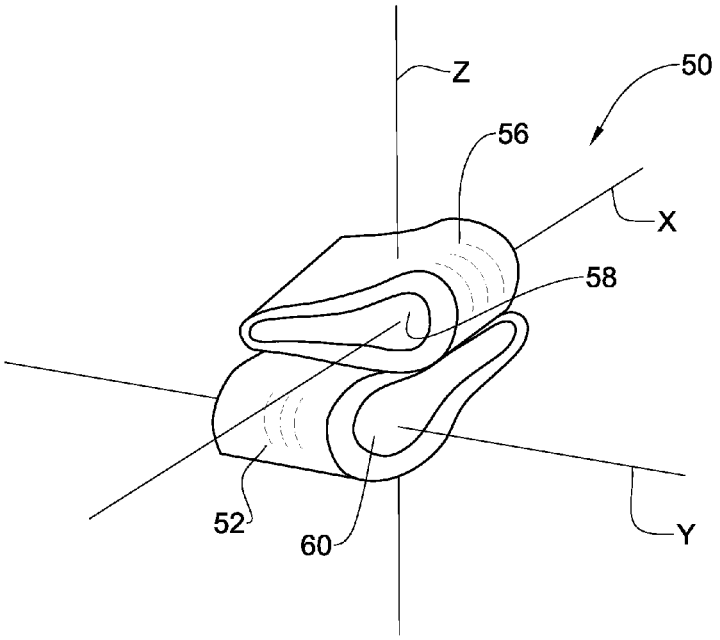
FIG. 1D is an example of an arch configuration member according to the presently disclosed subject matter.

According to one example illustrated in FIG. 1D, an arch configuration member 50 is illustrated comprising two arch receiving members 52 and 56 which may be fixed to another or pivotally secured to one another, each configured with an arch receiving channel 58 and 60 respectively, defining respective axes X and Y corresponding with the longitudinal axis of each of the arches received thereby. The arch receiving channels 58 and 60 are configured, as far as shape and size, such that an individual may actively slide the arch configuration member 50 along one or both arches, arresting however sliding motion and preventing spontaneous displacement of the arches unintentionally, thereby fixing the respective position of the arches and thereby recreating a new activity space. Friction increasing projections may be formed within the arch receiving channels 58 and 60.

During the movement of the arch configuration member 50, the arch receiving members 52 and 56 are configured for rotating at least with respect to the Z axis, adjusting thereby to the configuration of the arches received therein.

Figure 2A:
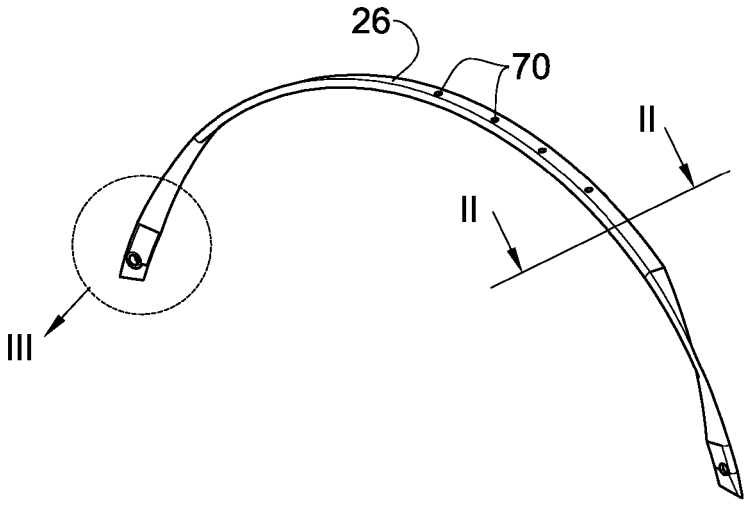
FIG. 2A is an isometric view of an arch used in conjunction with the activity mat of the presently disclosed subject matter.
Figure 2B:
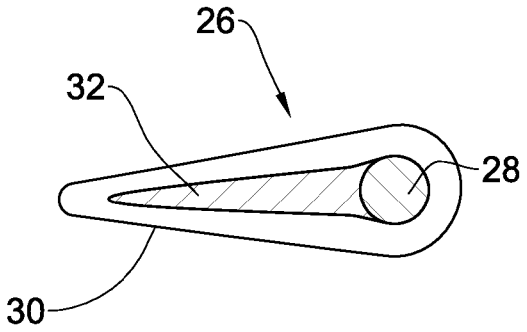
FIG. 2B is a section of an arch taken along line II-II in FIG. 2A.
Figure 3A:
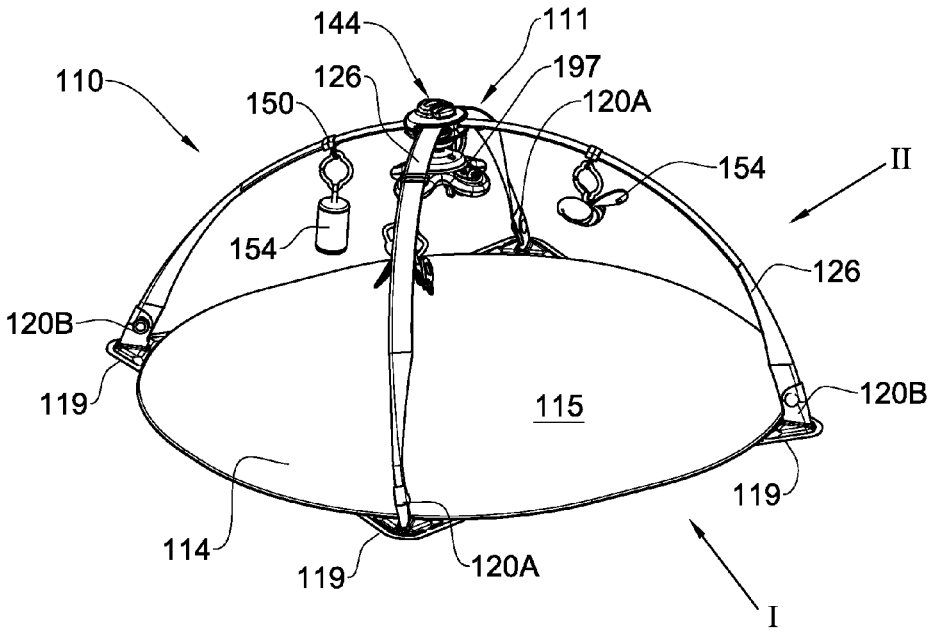
FIG. 3A is a top perspective view of an activity mat in accordance with the presently disclosed subject matter.
Figure 3B:
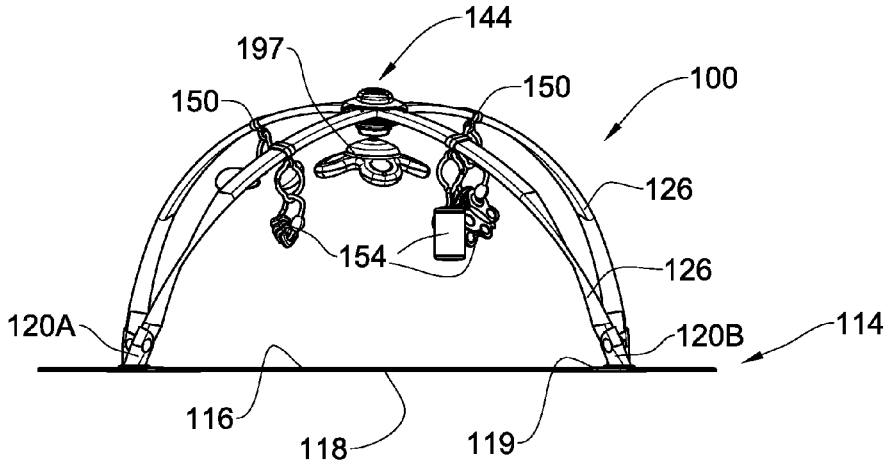
FIG. 3B is a front view of the activity mat, taken in the direction of arrow marked I in FIG. 3A.
Figure 3C:
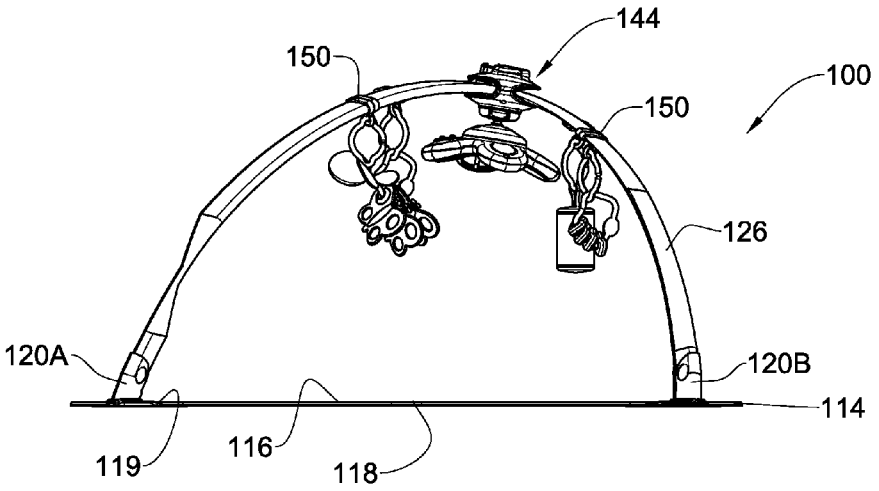
FIG. 3C is a side view taken in direction of arrow marked II in FIG. 3A.
Figure 3D:
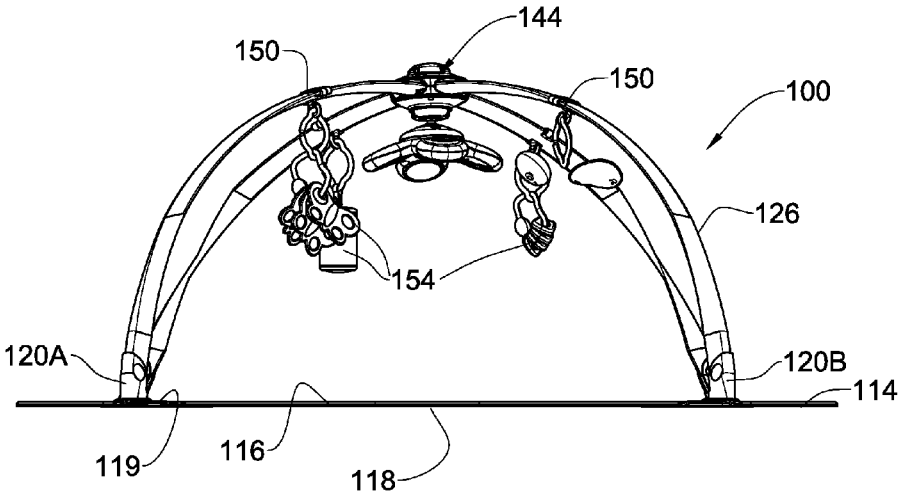
FIG. 3D is a rear view of FIG. 3A.
Figure 3E:
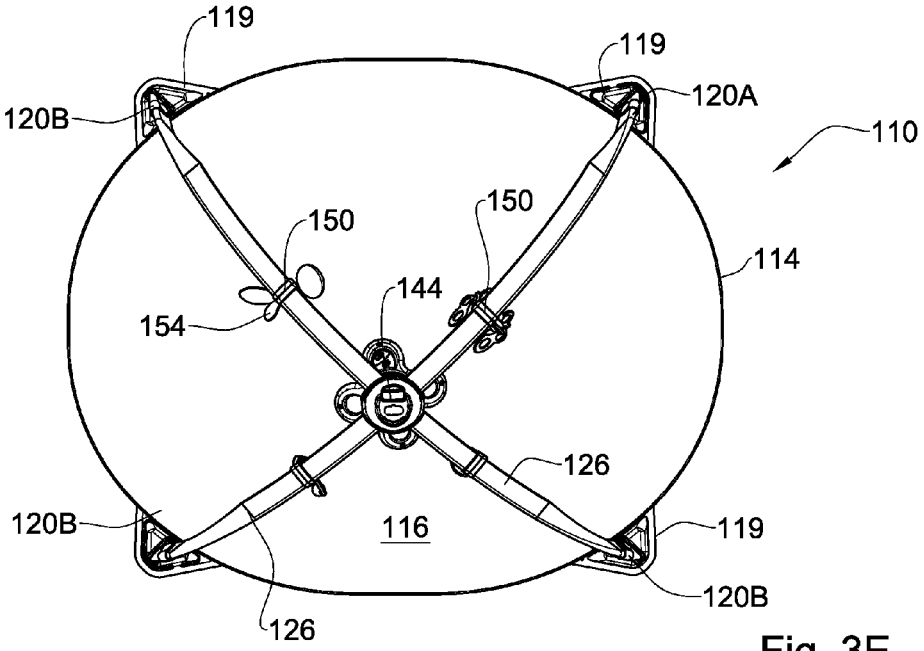
FIG. 3E is a top view of FIG. 3A.
Figure 3F:
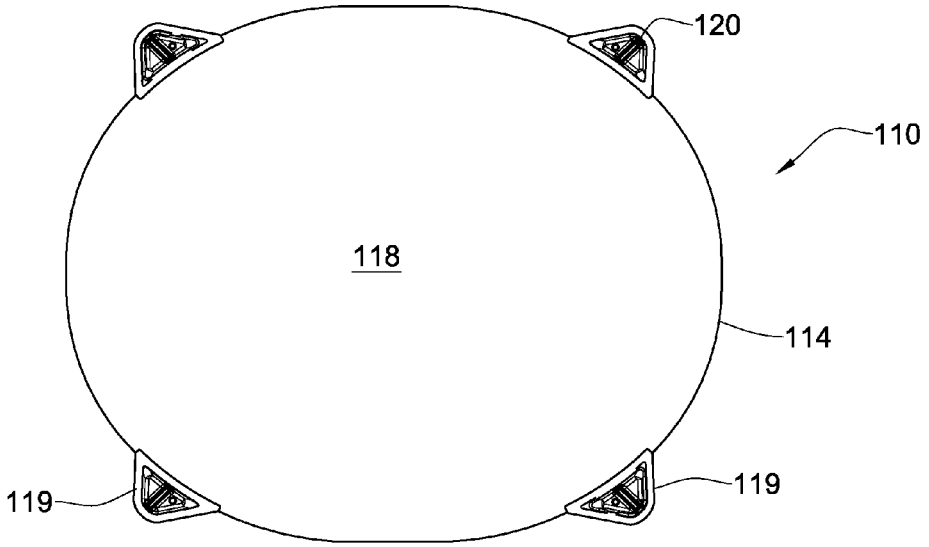
FIG. 3F is a bottom view of the activity mat illustrated in FIG. 3A.

With reference to FIGS. 2A and 2B, the arches 26 can comprise a rigid portion 28, such as a carbon rods, reinforced composite material or plastic material, received within a sheath-like coating 30 made of eye-pleasing flexible material, likely with a layer of padding material 32, such as foamed material or sponge. The arches 26 can further comprise holes 70 for suspending stimulating elements such as toys.

With reference to FIGS. 3A to 3F of the drawings illustrating an infant activity mat in accordance with the disclosed subject matter generally designated 110 and comprising an activity device 111 having a pair of arches 126 and a arch configuration member 144, and a floor mat 114 made of a pliable/flexible padded material e.g. two layers of fabric with a layer of sponge or foamed material stitched therebetween. In accordance with a particular design, the floor mat 114 has a top surface 115 and a bottom surface 118 (FIG. 3F) each being patterned and colored in a different fashion, whereby the floor mat 114 may be used with either surface facing upwards.

In the particular example, the floor mat 114 is substantially circular though it is appreciated that other forms may be acquired as well, e.g. oval, rectangle, etc. Laterally projecting from a perimeter of the floor mat 114 there are arch coupler supports 119, coextensive with the mat 114, each supporting an arch coupler element 120. The arch coupler elements are paired 120A and 120B, the arrangement being such that each pair 120A and 120B extends about an imaginary diameter of the floor mat 114 such that when tensioned by the arches (as will be discussed hereinafter) the floor mat 114 assumes a substantially flat and smooth configuration, tensioned by the arches. The structure of the arch coupler elements 120A and 120B will be discussed hereinafter in further detail with reference to FIGS. 5A-5D.

Figure 7A:
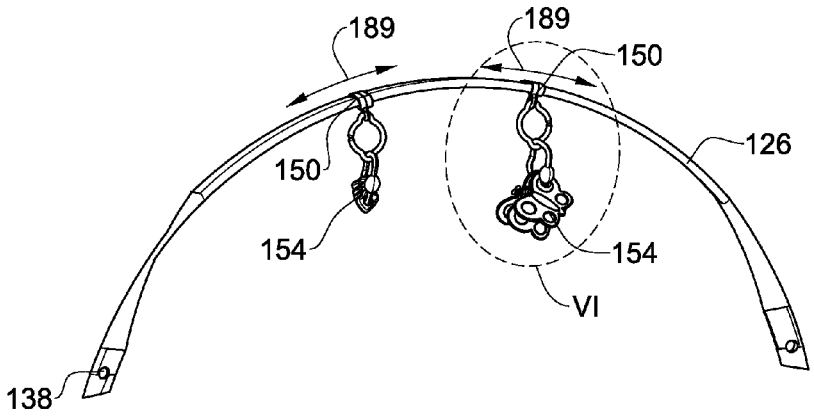
FIGS. 7A and 7B are isometric views of an arch fitted with two stimulating elements dangling therefrom, at two respective positions.
Figure 7B:
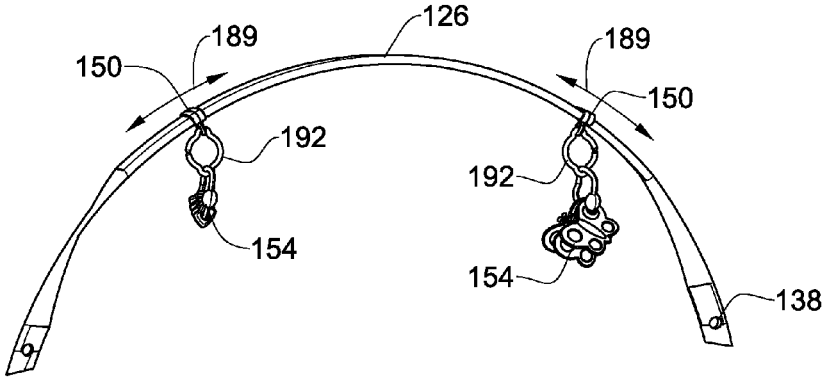
Figure 7C:
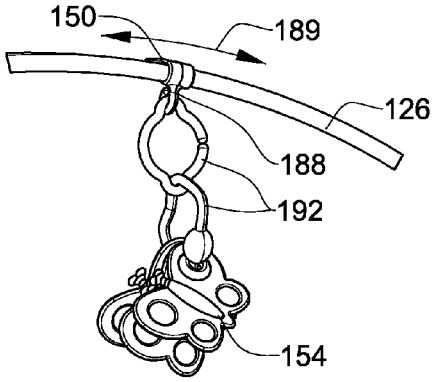
FIG. 7C is an enlargement of the portion marked VI-VI in FIG. 7A.
Figure 7D:
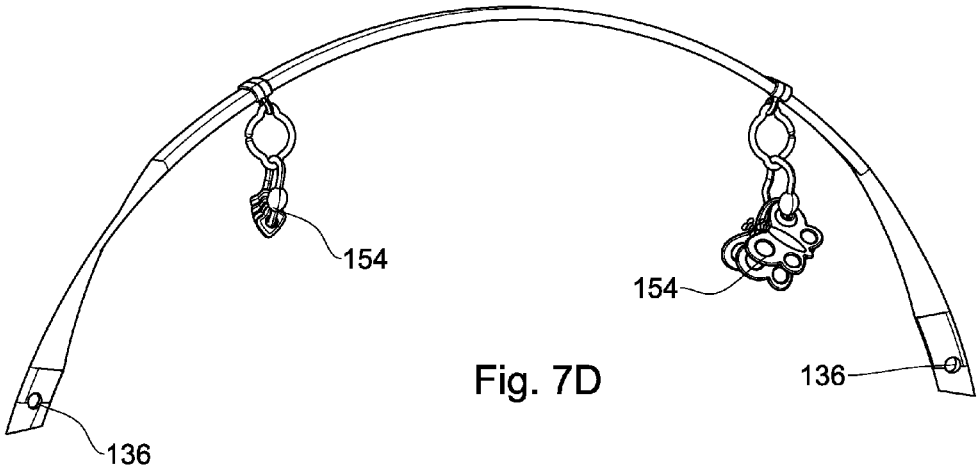
FIG. 7D is an enlarged view of FIG. 7B.

As seen in FIG. 7D, each arch has smooth, rounded ends; and is fitted at its respective ends with a coupler eye 136 (also shown in FIG. 4) giving rise to a reinforced opening 138 which as will be discussed hereinafter serves for coupling with a respective arch coupler element 120A/120B.

Figure 8A:
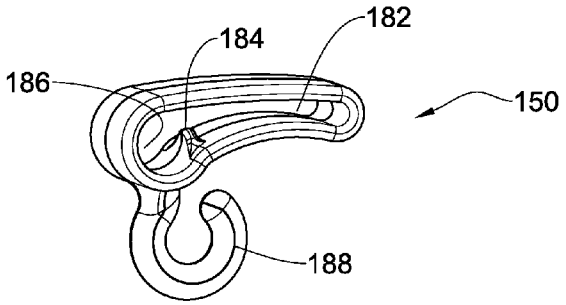
FIGS. 8A and 8B are respective isometric and side views of a stimulating element coupler according to the disclosed subject matter.
Figure 8B:
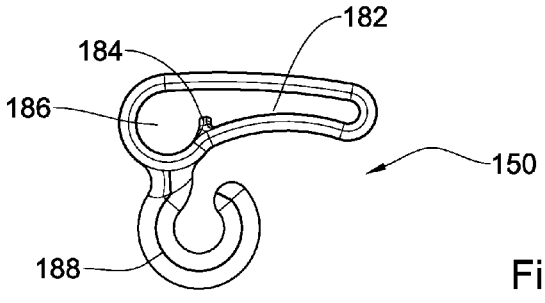

Further noticed, the activity mat 110 is provided with several stimulating element couplers 150, seen in further detail in FIGS. 8A and 8B, configured for sliding displacement over an arch 126 and for retaining their position by friction over the arch, and further for dangling articulation therefrom of a stimulating element, collectively designated 154.

Figure 4:
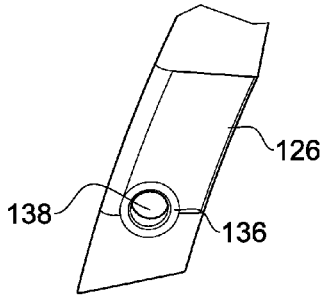
FIG. 4 is an enlargement of the portion marked III in FIG. 2.
Figure 5A:
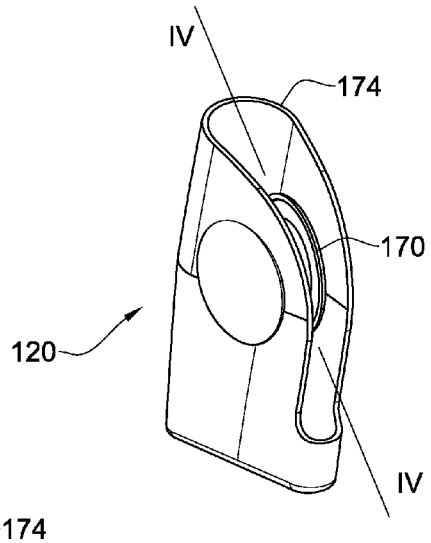
FIG. 5A is a respective view of an arch coupler of the activity mat according to the presently disclosed subject matter.
Figure 5B:
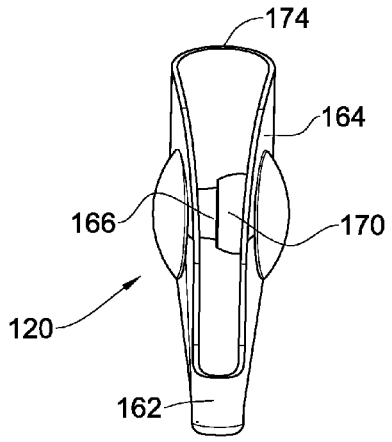
FIG. 5B is a front view of the arch coupler of FIG. 4A.
Figure 5C:
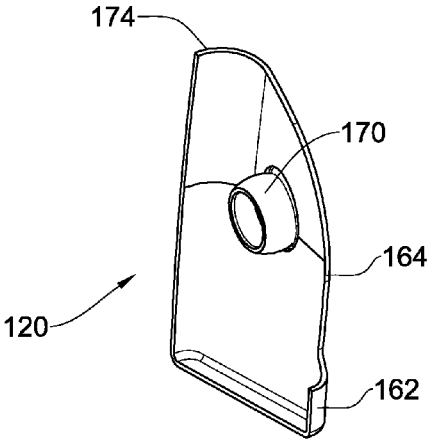
FIG. 5C is a left isometric view of the arch coupler sectioned along line IV-IV in FIG. 5A.
Figure 5D:
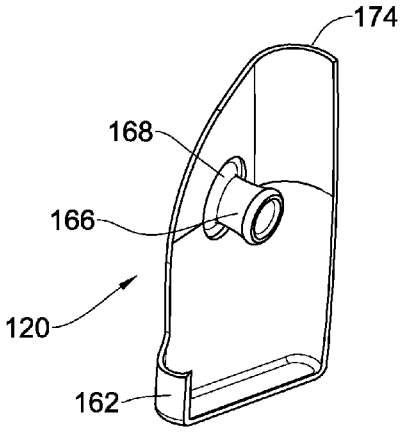
FIG. 5D is a right isometric view of the arch coupler, sectioned along line IV-IV in FIG. 5A.
Figure 6A:
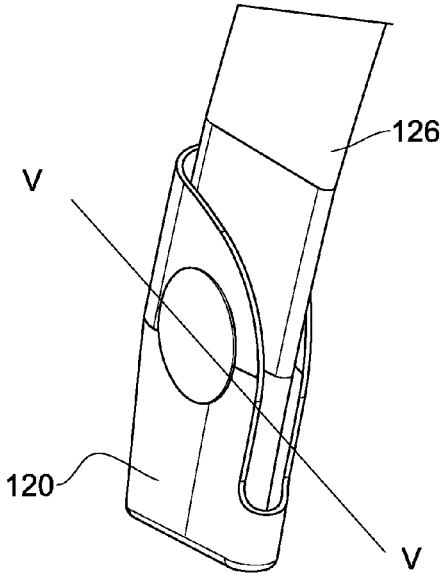
FIG. 6A is an isometric view of an arch engaged with an arched coupler in accordance with the presently disclosed subject matter.
Figure 6B:
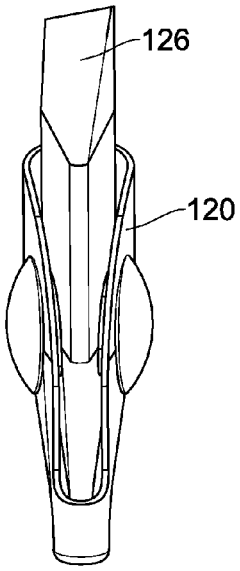
FIG. 6B is a front view of the assembly of FIG. 6A.
Figure 6C:
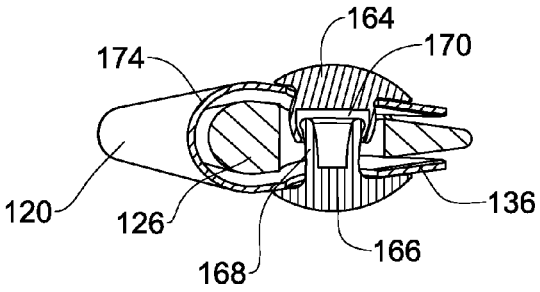
FIG. 6C is a section taken along line V-V in FIG. 6A.

Turning now to FIGS. 4 to 6 it will be explained how the arches 126 are securely though easily detachably, coupled to the arch coupler elements 120. As noted, each of the arch coupler elements 120A and 120B is composed of a housing 162 (best seen in FIGS. 5C and 5D) which housing is securely coupled or integrated with the arch coupler support 119. The arch coupler element comprises two flexible sidewalls 164 and 166 wherein a snap-type coupler is provided in the form of a projecting male element 168 extending from wall 166 and a corresponding female locking element 170 fitted on wall 164, wherein the diameter of male projection 166 is smaller than that of the opening 138 formed at the end of each of the arches 126 and further, wherein the arch coupler elements 120, at their snappingly closed position (e.g. FIGS. 5A, 5B and 6C) define a space 174 for supporting the respective end of the arch 126, whereby the arch 126 is both supported by the pocket-like construction of the arch coupler element 120 and yet being locked and engaged to prevent spontaneous disengagement therefrom by means of the snap lock coupler composed of male projection 168 and female lock 170.

With further reference being now made to FIGS. 8A and 8B, there is illustrated the stimulating element coupler 150 and it is seen to comprise an opening 182 configured for sliding over the sheath of the arch 126 and for that purpose has a cross section for essentially corresponding with that of the arch 126. Furthermore, it is noticed that projecting into the opening 182 there is a prong 184 designed for increasing friction engagement over the arch 126, giving rise to a semi-circular portion 186 embracing the rigid portion of the rod 128 of the arch 126. The stimulating element coupler 150 is slidable over and along the arch 126 in direction of arrowed line 189, however, owing to friction the stimulating element coupler 150 and the element articulated thereto, will spontaneously displace over the arch. Integrated and extending below there is a hook portion 188 for articulation thereto of various arches, e.g. stimulating article 154, either directly or through one or more links 192. It is appreciated that the stimulating element coupler may assume different shapes and designs, however configured for axial displacement over an arch and retention thereof at any desired location. This may be facilitated by friction engagement over the arch or by appropriate clamping arrangements.

Figure 9A:
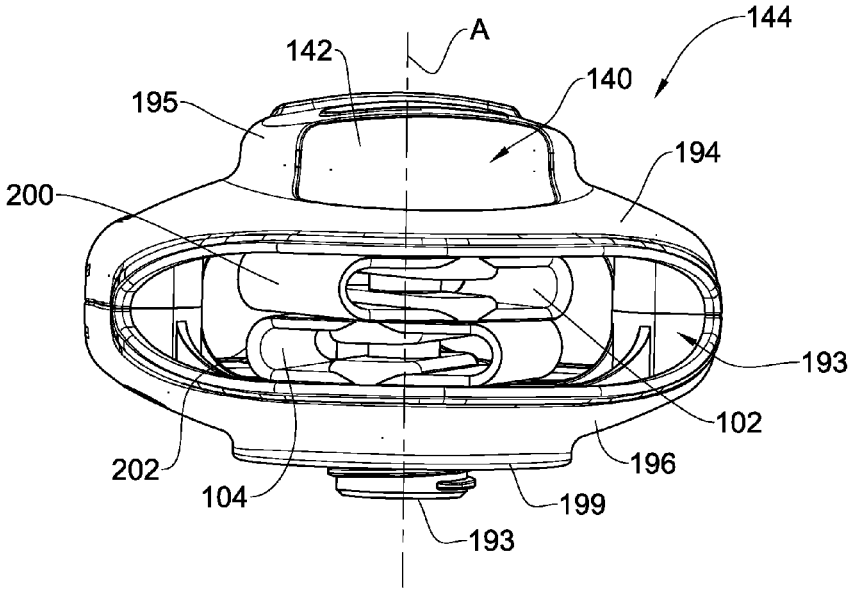
FIGS. 9A and 9B are front and back views of an arch configuration member in accordance with another example of the disclosed subject matter.
Figure 9B:
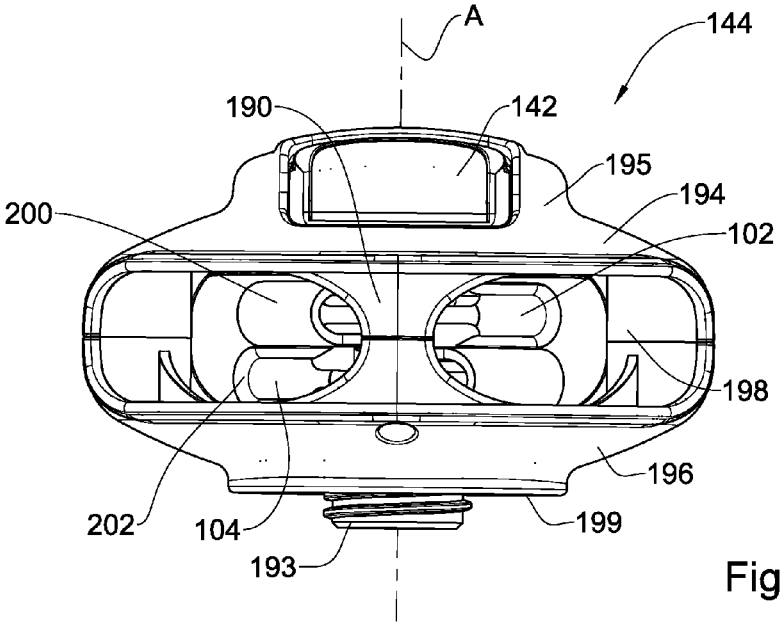
Figure 9C:
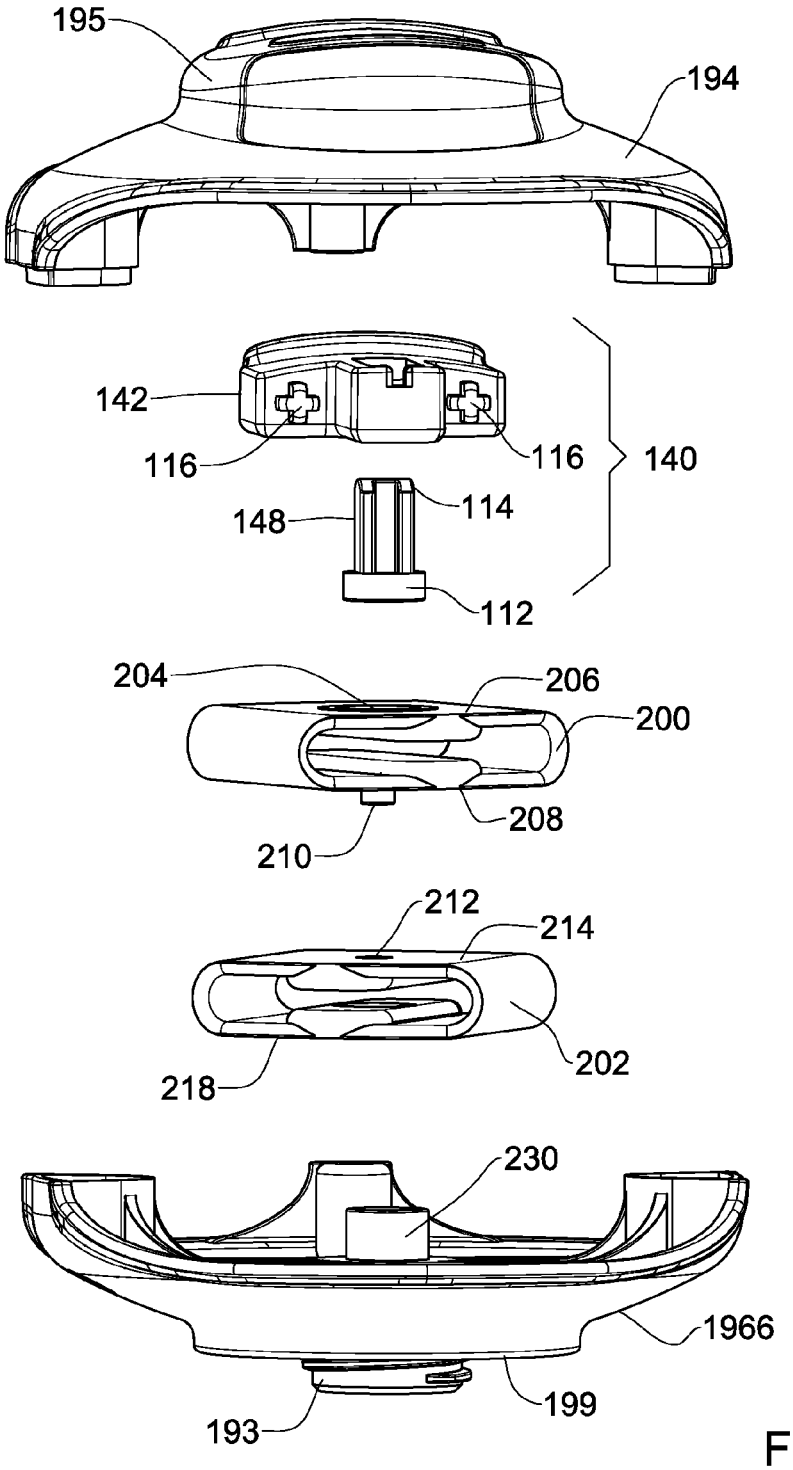
FIG. 9C is an exploded isometric view of the arch configuration member illustrated in FIGS. 9A and 9B.

FIGS. 9A to 9C illustrate an arch configuration member 144 according to one example of the presently disclosed subject matter having an axis of symmetry A and comprising a rigid housing 192 having a top cover 194 and a bottom cover 196 defining therebetween a space 198 fitted with two throughgoing sliding top and bottom members 200 and 202 substantially perpendicular to the axis A, having arch receiving channels 102 and 104, each configured for receiving therethrough an arch 126.

The top and the bottom covers 194 and 196 may form (although not necessarily), at one side of the housing 192 a partition wall 190 separating between the arches 126 and preventing them from undesired overlapping.

Figure 10A:
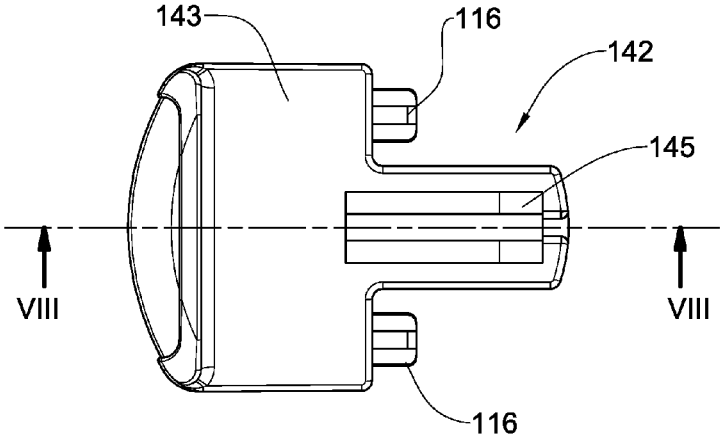
FIG. 10A is a top view of a pressing knob of the arch configuration member illustrated in FIGS. 9A to 9C.
Figure 10B:
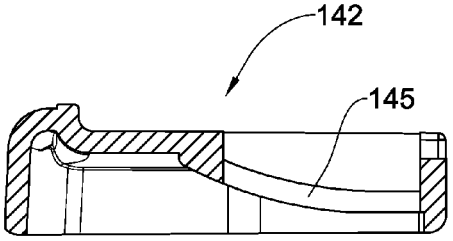
FIG. 10B is a section of the pressing knob taken along line VIII-VIII in FIG. 10A.

The arch configuration member 144 further comprises a releasing/retention mechanism 140 comprising in turn a pressing knob 142 received within a top cover receptacle 195, two springs (not shown) attached to the knob 142 at 116 and biased against an inner wall (not seen) of the top cover 194, and a plunger 148 projecting downwardly from the top cover 194 into the space 198. The plunger 148 comprises a top end 114 slidingly fitted within a plunger receiving curved channel 145 extending along a bottom surface 143 of the pressing knob 142 (FIGS. 10A and 10B) and a bottom end 112 received within a corresponding recess 204 on a top surface 206 of the sliding member 200.

On its bottom surface 208, the sliding member 200 is fitted with a protrusion 210 to be received within a corresponding recess 212 on a top surface 214 of the sliding member 202, which in turn is fitted over a bottom support 230 upwardly extending from the bottom cover 196 into a recess 216 (not seen) on a bottom surface 218 thereof.

Figure 9D:
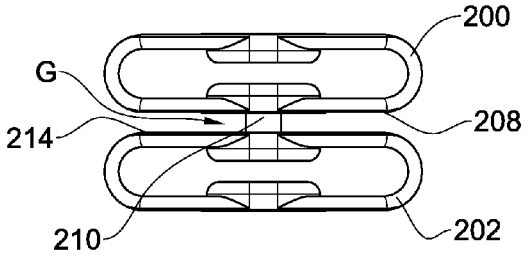
FIGS. 9D and 9E are front views of sliding members of the arch configuration member illustrated in FIGS. 9A to 9C in different mutual configurations.
Figure 9E:
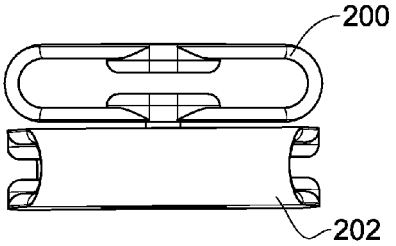

The arrangement is such that normally the sliding members 200 and 202 are pressed one towards the other by the plunger 148 and the bottom support 230, so that the protrusion 210 is entirely received within the recess 204, as shown for example in FIG. 9E, restricting thereby the displacement of the arch configuration member 144 over the arches 126.

When it is desired to reconfigure the activity space of the activity mat, namely to change the configuration of the arches 126, the knob 142 is pressed against the springs 116 releasing thereby the pressure applied by the plunger 148 (displaced along the curved channel 145) on the sliding member 200, increasing a gap G (FIG. 9D) between the sliding members 200 and 202 and facilitating thereby the displacement of the arch configuration member over the arches 126 resulting in changing their configuration and consequently the activity space.

During the displacement of the arch configuration member 144, the sliding members 200 and 202 are configured for rotating at least with respect to the axis A, adjusting thereby to the configuration of the arches received therein. In particular, the sliding members are configured to take any mutual configuration in a range between a perpendicular configuration (FIG. 9D) and a parallel configuration (FIG. 9E).

The arch configuration member 144 may be displaced with respect to only one of the arches 126 changing thereby configuration of the other arch with respect to the mat.

The arch configuration member, according to the presently disclosed subject matter, may be used without having to manipulate any pressing member or the like, relying only on friction between the devise and the respective arches 226, whereby the arches may be displaced to reconfigure the activity space by arresting the arches at a desired position with respect to one another and arresting them at that desired configuration.

A bottom surface 199 of the arch configuration member 144 is provided with a toy 197 (FIGS. 3A and 3B) attached by screwing engagement to a thread 193 (FIGS. 9A to 9C) hanging within the activity space or may be provided for example with an ornamental pattern or a reflecting surface (a mirror) for amusement of an infant laying below and occupying the activity space.

Figure 11A:
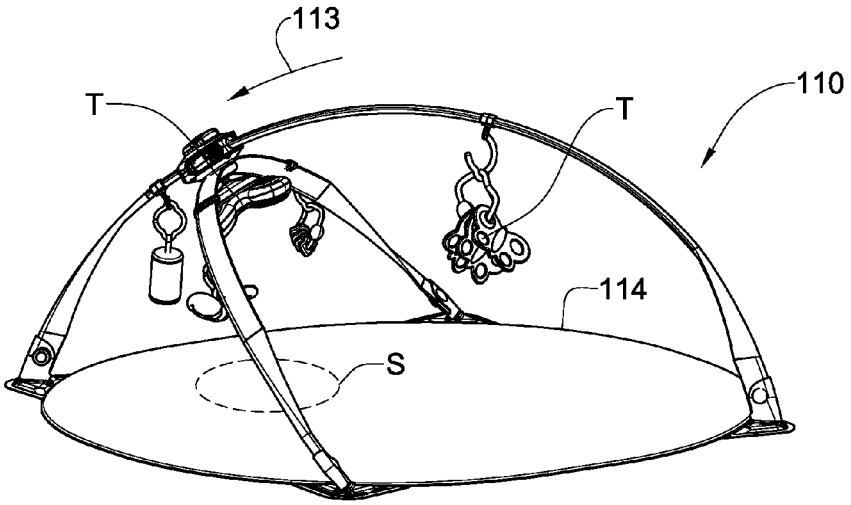
FIGS. 11A and 11B illustrate the activity mat with the activity space altered into different configurations by modification of the position of the arches.
Figure 11B:
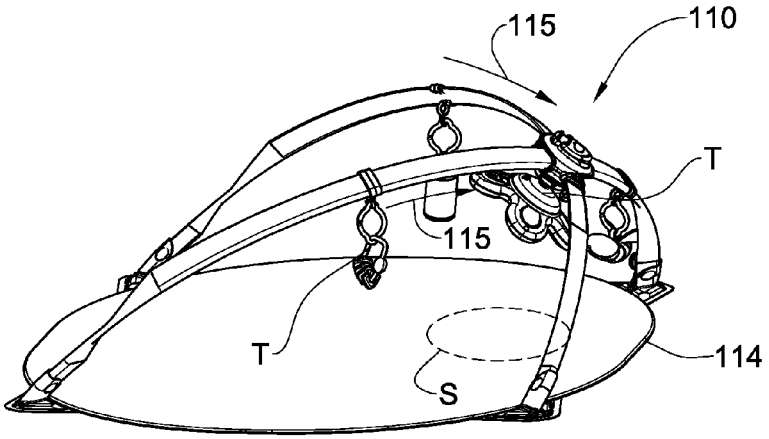

FIGS. 11A and 11B the activity mat 110 according to the presently disclosed subject matter is illustrated in a different configurations owing to displacement of the arch configuration member 144 in direction of arrows 313 and 315 resulting in creation of a different activity space S above the mat 114, whereby the hanging toys T now extend lower above the surface of the mat.

Those skilled in the art to which this invention pertains will readily appreciate that numerous changes, variations, and modifications can be made without departing from the scope of the invention. Mutatis Mutandis. For example, the arch coupler elements may extend at both sides of the arch coupler supports 119 or may be detachably attached at either face thereof, whereby the floor mat 114 may be used with either face up.

The invention claimed is:

1. An infant activity device, comprising:

two or more arches each having a longitudinal axis, the two or more arches creating an activity space extending below a location of articulation of the arches; and an arch configuration member configured for displacement between different articulation configurations of the two or more arches by sliding with respect to at least one arch of the two or more arches, the arch configuration member further configured for retaining the two or more arches at any desired articulation configuration to thereby alter the activity space;

wherein the arch configuration member includes arch receptacles each of which includes an arch receiving channel configured for slidingly receiving therein a respective arch of the two or more arches and defines sliding axes X and Y, each of the sliding axes X and Y respectively corresponding to one of the longitudinal axes of the two or more arches, the sliding axes X and Y sharing a common axis Z that is substantially normal to the sliding axes X and Y.

2. The infant activity device according to claim 1, wherein the location of articulation of the two or more arches is a location of a minimal distance therebetween.

3. The infant activity device according to claim 1, wherein the arch configuration member is retained at the location of articulation when retaining the two or more arches in an articulation configuration corresponding to the location.

4. The infant activity device according to claim 1, wherein the arch configuration member comprises at least one arch receptacle configured for slidingly receiving therein the two or more arches.

5. The infant activity device according to claim 1, wherein the arch configuration member comprises a retention mechanism for retaining the two or more arches in the desired articulation configuration.

6. The infant activity device according to claim 1, wherein the arch configuration member is retained in position by friction between the arch configuration member and the two or more arches.

7. The infant activity device according to claim 1, wherein the two or more arches are configured to be detachably attached to infant equipment, and wherein the infant equipment includes at least one of activity mat, a bed, a bouncer, a safety chair, a cradle, or a stroller.

8. The infant activity device according to claim 7, wherein the two or more arches comprise one or more attachment points for detachable attachment to the infant equipment and with respect to which the two or more arches are configured to change their articulation configuration.

9. The infant activity device according to claim 7, wherein the two or more arches comprise two or more arch couplers for detachably attaching the two or more arches to the infant equipment.

10. The infant activity device according to claim 1, further comprising at least one stimulating element is configured to be detachably attached to the arch configuration member.

11. An arch configuration member for use in an activity device having two or more arches each having a longitudinal axis, the two or more arches creating an activity space extending below a location of articulation of the two or more arches, the arch configuration member comprising:

at least two arch receptacles each of which is configured for:

slidingly receiving therein a respective arch of the two or more arches;

displacement between different articulation configurations of the two or more arches by sliding with respect to at least one arch of the two or more arches; and retaining the two or more arches at any desired articulation configuration to thereby alter the activity space;

wherein each of the at least two arch receptacles includes an arch receiving channel configured for slidingly receiving therein a respective arch of the two or more arches and defines a sliding axis corresponding to one of the longitudinal axes of the two or more arches, the sliding axes of the arch receiving channels of the at least two arch receptacles sharing a common axis that is substantially normal to the sliding axes.

* * * * *